United States Patent [19]

Hecock et al.

[11] Patent Number: 4,557,409

[45] Date of Patent: Dec. 10, 1985

[54] ELECTRICAL GROUNDING ROD DRIVING DEVICE

[75] Inventors: J. Edwin Hecock, Wauseon; James O. Mumper, Tiffin, both of Ohio

[73] Assignee: E & J Demark, Inc., Wauseon, Ohio

[21] Appl. No.: 591,311

[22] Filed: Mar. 19, 1984

[51] Int. Cl.[4] ..... B25C 1/02; B25D 9/00

[52] U.S. Cl. ..... 227/147; 173/91; 175/22; 175/23

[58] Field of Search ..... 173/90, 91, 128; 175/19, 20, 21, 22, 203; 227/147, 156

[56] References Cited

U.S. PATENT DOCUMENTS

| | | | |
|---|---|---|---|
| 1,147,791 | 7/1915 | Dunbar | 175/23 |
| 2,147,828 | 2/1939 | Daniels | 175/22 X |
| 2,629,985 | 3/1953 | McDowell | 173/91 |
| 3,117,378 | 1/1964 | Bowen | 227/147 X |
| 4,315,551 | 2/1982 | Iannone | 227/147 X |

*Primary Examiner*—Paul A. Bell

*Attorney, Agent, or Firm*—William F. Frank

[57] ABSTRACT

The present invention is a double-headed hammer slidingly encompassing a ground rod driving shaft having a single anvil affixed thereto which can be selectively engaged by either hammer. The driving shaft has a recess in each end to receive the grounding rod, depending upon whether the action is to initiate and continue the insertion of grounding rod into the ground or to complete the insertion of the rod in accordance with the provisions of the Code. The present invention does not require the operator to take a position above the ground or to use any other instrument to make the complete and proper insertion of the grounding rod into the ground.

1 Claim, 5 Drawing Figures

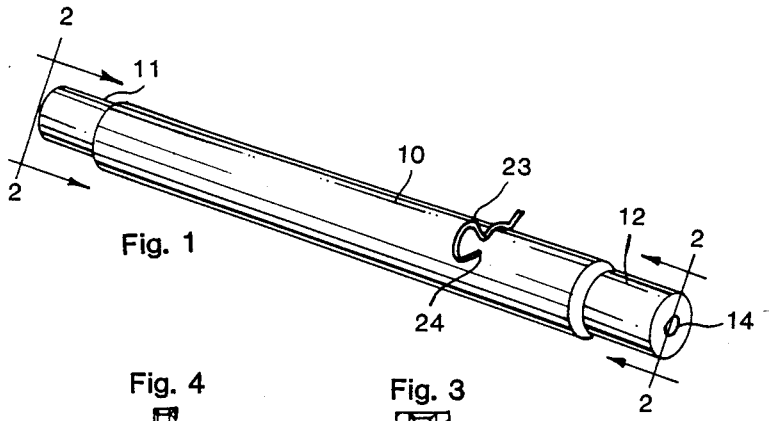
Fig. 1
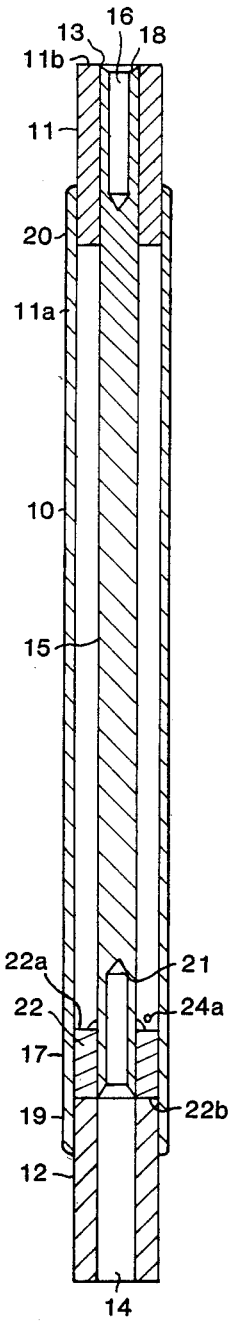
Fig. 2
Fig. 4
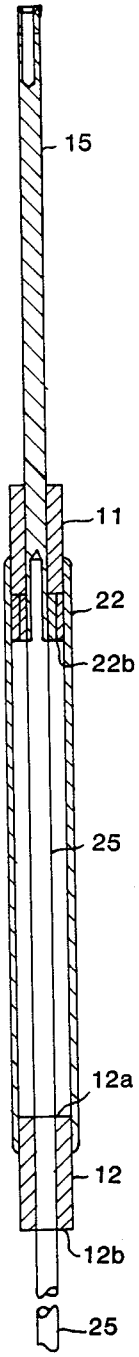
Fig. 3
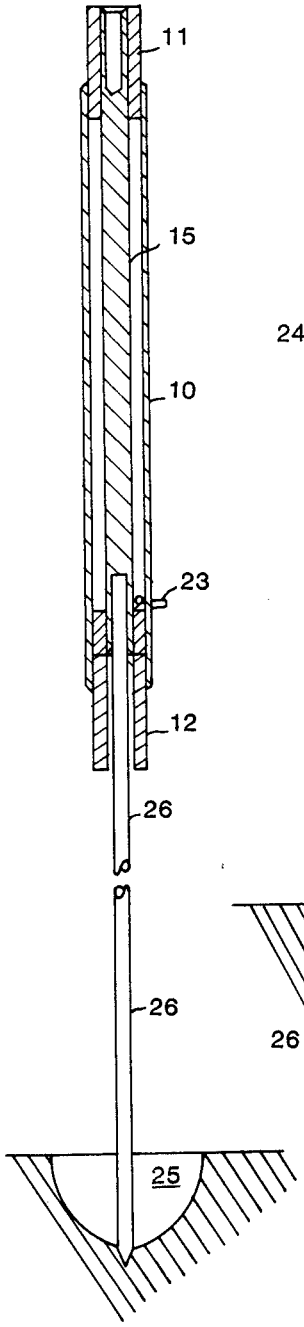
Fig. 5
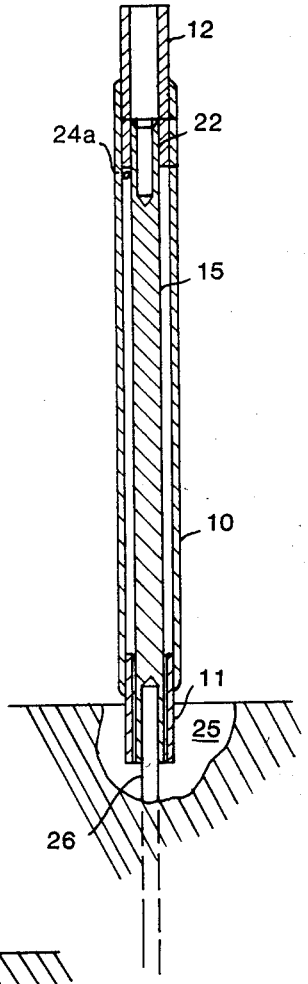

ELECTRICAL GROUNDING ROD DRIVING DEVICE

FIELD OF INVENTION

The present invention is in the field of electrical conductors. More specifically, the invention is in the field of devices with which an electrical grounding rod is driven into the ground.

BACKGROUND OF THE INVENTION

Electrical grounding rods are required to insure that line electrical apparatus, for example, electrical power transmission systems and the sub-stations connected therewith as well as telephone lines, are kept at earth potential. Steel structures such as oil well derricks and windmills should be grounded as a precautionary measure against lightning strikes. Lightning arrester systems to protect structures extending well above ground level must be grounded. In the past, grounding rods have been of various lengths and have been hollow or solid and generally have terminated with a short portion of the grounding rod projecting above ground. Hollow rods were driven into the ground using a point of a hard metal to which one end of the rod was attached or on which the hollow end rested. A wooden rod was inserted into the hollow grounding rod into contact with the point. In some instances the other end of the wooden driving rod was struck with a hammer-like device. In other instances the other end of the wooden driving rod has a weight attached thereto, and the rod was moved up and down inside the hollow grounding rod. (see U.S. Pat. Nos. 1.147,791; 1.962,758; 2.145.420 and 2.147.828). To use these devices it was necessary for the operator to stand on some object which would enable him to bring the necessary force onto the top of the device (see 21147.828). An improvement over these devices is disclosed in U.S. Pat. No. 4.335.622 wherein a soil gas sampling probe is driven into the soil by means of a collar which is secured to the probe as an anvil and a cylindrical mass is slipped over the probe and strikes the anvil as a hammer by raising it up and bringing it down into contact with the anvil. This device will permit driving the probe into the ground until only that length represented by the depth of the collar and length of the hammer is left above ground level.

The National Electrical Code has established that grounding rods shall be 8 feet in length, generally of solid stock and shall be driven into the ground so that the top of the rod is about 12 inches below ground level. The first above-described devices can meet this requirement but are difficult to initiate the driving. The last above-described device eases the the task of driving the rod into the ground but must be removed and a hammer used to drive the remaining length of the rod below the ground level or a deeper hole must be initially dug.

SUMMARY OF THE PRESENT INVENTION

The present invention is a double-headed hammer slidingly encompassing a ground rod driving shaft having a single anvil affixed thereto which can be selectively engaged by either hammer. The driving shaft has a recess in each end to receive the grounding rod, depending upon whether the action is to initiate and continue the insertion of grounding rod into the ground or to complete the insertion of the rod in accordance with the provisions of the Code. The present invention does not require the operator to take a position above the ground or to use any other instrument to make the complete and proper insertion of the grounding rod into the ground.

BRIEF DESCRIPTION OF THE DRAWINGS

An illustrative embodiment of the present invention for driving an electrical grounding rod into the ground in accordance with provisions of the National Electrical Code is shown in the accompanying drawings in which:

FIG. 1 is a perspective view of the present invention in the storage mode.

FIG. 2 is a cross-sectional view of the present invention along the plane 2—2 in FIG. 1.

FIG. 3 is a partial cross-sectional view of the present invention in position on a grounding rod to initiate insertion.

FIG. 4 is a partial cross-sectional view of the present invention in the driving position.

FIG. 5 is a partial cross-sectional view of the present invention in position to complete the insertion of the grounding rod as required by the Code.

DETAILED DESCRIPTION OF THE INVENTION

Referring to FIGS. 1 and 2, The present invention comprises a metal cylinder 10 having a metal cylindrical hammer 11 and 12 securely mounted interiorly at each end as by welding. Hammers 11 and 12 have resepctive bores 13 and 14. Bore 13 receives grounding rod driving shaft 15 in sliding relationship. Driving shaft 15 carries a grounding rod receiving recess 16 and 17 in each of its respective ends. Each of the recesses 16 and 17 has a champfered surface, 18 and 19 respectively, at its opening to facilitate the insertion of the non-pointed end of a grounding rod. The interior end of each recess 16 and 17 is a concave surface, 20 and 21 respectively, matching the end surface of the drill used to make the recess. Retaining this configuration not only eliminates the cost of boring out the end into a vertical surface but precludes any outward peening of the end of the grounding rod during the driving. Secured to the end of driving shaft 15 opposite the end encompassed by hammer 13 is a cylindrical anvil 22 having striking surfaces **22*a* and 22*b* respectively. A biased locking pin 23 is inserted into openings 24*a* and 24*b* in the wall of cylinder 10 which are in position just above striking surface 22*a* of anvil 22 to hold cylinder 10 and shaft 15 in the storage mode shown in FIGS. 1 and 2**.

To install a grounding rod with the present invention a hole 12–15 inches deep is prepared. The present invention in the storage mode is then placed over the non-pointed end of the 8 foot grounding rod as shown in FIG. 3, and the pointed end of the grounding rod placed in the bottom of the hole. This leaves about 7 feet of the grounding rod plus the length of the present invention extending above ground, well within the reach of the average operator. The locking pin 23 is then removed, and the cylinder 10 bearing hammers 11 and 12 is lowered until hammer striking face **13*a* is in contact with anvil striking surface 22*a*, bringing the center of the cylinder 10 to a height less than 6 feet above ground level as shown in FIG. 4. Driving the ground rod is accomplished by lifting cylinder 10 and bringing it down repeatedly for the contact between striking face 13*a* and striking surface 22*a*. This is continued until the outer surface 12*b* of hammer 12 touches the bottom of hole 25. The present invention is then removed from the grounding rod and inverted so that the remaining end of the grounding rod above ground is re-inserted into recess 16 as shown in FIG. 5. Cylinder 10 is then raised and lowered repeatedly for contact between hammer striking face 12***b* and anvil striking surface 22*b*. until the end 20*a* of the grounding rod 26 is the required distance below ground level.

For testing, the present invention was constructed with cylinder 10 length of 22 inches and an outside diameter of 2⅜ inches. Hammers 11 and 12 had an overall length of 4 inches each, extending 3 inches beyond the respective ends of cylinder 10, each with an outside diameter of 2 inches. Driving shaft 15 had an overall length of 24 inches with recesses 16 and 17 each of 3 inch depth, the shaft having an outside diameter of 1 inch. Anvil 22 had a length of 1½ inches and an outside diameter of 2 inches.

While recesses 16 and 17 are shown with a circular cross-section, the shape of the rod to be driven can be determinant. The principle of the present invention can be applied to a driver for any type or purpose rod.

What is claimed is:

1. An electrical grounding rod driving device comprising an elongated cylinder having a hammer secured within each end portion and encompassing a ground rod receiving and driving shaft having a single anvil affixed to one end thereof within said cylinder and having opposing striking surfaces for selective engagement by the striking face of either hammer, the driving shaft having a recess in each end for selective engagement of one end of said rod, and means to lock said cylinder and said shaft in non-operable position.

* * * * *